US012778187B2

(12) United States Patent
Zitturi et al.

(10) Patent No.: US 12,778,187 B2
(45) Date of Patent: Nov. 3, 2026

(54) WRAPPING PAPER HAVING A LOW DIFFUSION CAPACITY

(71) Applicant: DELFORTGROUP AG, Traun (AT)

(72) Inventors: Roland Zitturi, Innsbruck (AT); Dietmar Volgger, Gnadenwald (AT)

(73) Assignee: DELFORTGROUP AG, Traun (AT)

( * ) Notice: Subject to any disclaimer, the term of this patent is extended or adjusted under 35 U.S.C. 154(b) by 558 days.

(21) Appl. No.: 18/276,906

(22) PCT Filed: Feb. 16, 2022

(86) PCT No.: PCT/EP2022/053727
§ 371 (c)(1),
(2) Date: Aug. 11, 2023

(87) PCT Pub. No.: WO2022/175292
PCT Pub. Date: Aug. 25, 2022

(65) Prior Publication Data

US 2024/0122231 A1 Apr. 18, 2024

(30) Foreign Application Priority Data

Feb. 22, 2021 (DE) ..... 102021104160.0

(51) Int. Cl.

| | |
|---|---|
| ***A24D 1/02*** | (2006.01) |
| ***A24D 1/20*** | (2020.01) |
| ***D21D 1/20*** | (2006.01) |
| ***D21G 9/00*** | (2006.01) |
| ***D21H 15/06*** | (2006.01) |
| ***D21H 17/00*** | (2006.01) |
| ***D21H 17/25*** | (2006.01) |
| ***D21H 17/28*** | (2006.01) |
| ***D21H 17/30*** | (2006.01) |

(52) U.S. Cl.
CPC ..... *A24D 1/02* (2013.01); *A24D 1/20* (2020.01); *D21D 1/20* (2013.01); *D21G 9/0018* (2013.01); *D21H 15/06* (2013.01); *D21H 17/25* (2013.01); *D21H 17/28* (2013.01); *D21H 17/30* (2013.01); *D21H 17/74* (2013.01)

(58) Field of Classification Search
CPC ..... D21H 15/06; D21H 17/25; D21H 17/28; D21H 17/30; D21H 17/74; D21H 27/00; A24D 1/02; A24D 1/20; D21D 1/20; D21D 99/00; D21G 9/0018; D21F 11/00
See application file for complete search history.

(56) References Cited

U.S. PATENT DOCUMENTS

| | | | | |
|---|---|---|---|---|
| 8,863,757 | B2 * | 10/2014 | Kraker | A24D 1/025 131/365 |
| 2002/0026948 | A1 * | 3/2002 | Hampl, Jr. | A24D 1/02 131/365 |
| 2009/0120450 | A1 * | 5/2009 | Herve | D21H 19/36 131/365 |
| 2013/0104915 | A1 | 5/2013 | Eitzinger | |
| 2014/0103099 | A1 * | 4/2014 | Snow | A24D 1/025 229/87.14 |
| 2014/0137880 | A1 * | 5/2014 | Zitturi | D21H 27/08 131/365 |
| 2014/0326262 | A1 | 11/2014 | Volgger | |
| 2016/0208440 | A1 * | 7/2016 | Byrd, Jr. | B65D 85/1045 |
| 2018/0092397 | A1 * | 4/2018 | Pesendorfer | D21H 27/00 |
| 2020/0397047 | A1 * | 12/2020 | Zhang | A24F 40/20 |
| 2020/0404971 | A1 * | 12/2020 | Jung | H05B 1/0227 |
| 2024/0122231 | A1 * | 4/2024 | Zitturi | D21H 15/06 |

FOREIGN PATENT DOCUMENTS

| | | | |
|---|---|---|---|
| CN | 1774184 | A | 5/2006 |
| CN | 107438370 | A | 12/2017 |
| CN | 112384657 | A | 2/2021 |

(Continued)

OTHER PUBLICATIONS

International Search Report and Written Opinion in Application No. PCT/EP2022/053727 dated May 27, 2022 (20 pages) [German language only].

(Continued)

*Primary Examiner* — Jose A Fortuna
(74) *Attorney, Agent, or Firm* — Barclay Damon LLP

(57) ABSTRACT

The invention relates to a wrapping paper for a smoking article, said wrapping paper comprising long-fibre pulp, short-fibre pulp, and inorganic filler, wherein: at least a portion of the long-fibre pulp is ground and the ground long-fibre pulp constitutes at least 15% and at most 70% of the mass of the wrapping paper, at least a portion of the short-fibre pulp is ground and the ground short-fibre pulp constitutes at least 5% and at most 80% of the mass of the wrapping paper, and the ground short-fibre pulp has a freeness value of at least 20° SR and at most 60° SR; the short-fibre pulp as a whole constitutes at least 10% and at most 80% of the mass of the wrapping paper, at least 5% and at most 45% of the mass of the wrapping paper is constituted by one or more inorganic fillers; the mass per unit area of the wrapping paper is at least 15 g/m$^2$ and at most 45 g/m$^2$; the diffusion capacity of the wrapping paper is at least 0.05 cm/s and at most 0.5 cm/s; and the standard deviation of the diffusion capacity of the wrapping paper is at most 0.05 cm/s. The invention also relates to an associated manufacturing method and to a smoking article making use of said wrapping paper.

11 Claims, No Drawings

(56) References Cited

FOREIGN PATENT DOCUMENTS

| | | | | | |
|---|---|---|---|---|---|
| CN | 117425414 | A | * | 1/2024 | ..... A24D 1/025 |
| DE | 145863 | A3 | | 1/1981 | |
| DE | 102015105882 | A1 | | 10/2016 | |
| EP | 1166656 | A2 | * | 1/2002 | ..... A24D 1/02 |
| JP | 2022519753 | A | * | 3/2022 | ..... A61K 31/658 |
| WO | 2011120687 | A1 | | 10/2011 | |
| WO | WO-2013013786 | A1 | * | 1/2013 | ..... D21H 27/08 |
| WO | 2013107627 | A1 | | 7/2013 | |
| WO | WO-2013137786 | A1 | * | 9/2013 | ..... H04L 41/0659 |
| WO | WO-2015062730 | A1 | * | 5/2015 | ..... C01F 11/185 |
| WO | 2016166012 | A1 | | 10/2016 | |
| WO | 2020201716 | A1 | | 10/2020 | |
| WO | WO-2022175292 | A1 | * | 8/2022 | ..... D21F 11/00 |

OTHER PUBLICATIONS

Chinese Office Action issued in CN 202280016118.6 dated Aug. 26, 2025 (18 pages).

Yong-sheng Gu et al., "Effect of Different Proportions of Wood Pulps on the Physical Characteristics of Cigarette and Ash Integration of Burning Cigarette" 1. Technology R & D Centre, China Tobacco Jiangsu Industrial Co., Ltd., Nanjing, Jiangsu Province, 210019, Nov. 30, 2018 with Abstract (6 pages).

English translation of the International Preliminary Report on Patentability in Application No. PCT/EP2022/053727 dated Aug. 22, 2023, 9 pages.

* cited by examiner

WRAPPING PAPER HAVING A LOW DIFFUSION CAPACITY

CROSS-REFERENCE TO RELATED APPLICATIONS

This application is the national phase entry of International Patent Application No. PCT/EP2022/053727, filed Feb. 16, 2022, and claims the benefit of German Patent Application No. 10 2021 104 160.0, filed Feb. 22, 2021, the disclosures of which are incorporated herein by reference in their entirety.

FIELD OF THE INVENTION

The invention relates to a wrapping paper with a low diffusion capacity for a smoking article, which provides the smoking article with a low smoldering speed or leads to self-extinguishing of the smoking article, and which has a low standard deviation of the diffusion capacity, as well as to a smoking article comprising such a wrapping paper and a process for manufacturing the wrapping paper.

BACKGROUND AND PRIOR ART

Smoking articles known in the prior art typically comprise an aerosol-generating material, as well as a paper that wraps the aerosol-generating material and thus forms a typically cylindrical rod. In many cases, the aerosol-generating material is tobacco or a processed tobacco material. Mostly, the smoking article also comprises a filter that filters components of the aerosol and is wrapped by a filter wrapping paper as well as by a further wrapping paper that connects the filter to the wrapped rod of aerosol-generating material.

Smoking articles that burn the aerosol-generating material during use, in particular cigarettes, represent an inherent fire risk. Legal regulations thus require that smoking articles are designed such that they self-extinguish with a probability of at least 75% in a test specified in ISO 12863:2010. A common way of complying with these legal requirements is to equip the wrapping paper of the smoking article with circumferential bands in the region of the aerosol-generating material, so that in the region of the bands, the diffusion of oxygen into the smoking article is so low that the smoking article extinguishes by itself. Such bands can, for example, be produced by the local application of film-forming compositions that locally reduce the diffusion capacity of the base paper.

Another option is to design the wrapping paper such that it has a low diffusion capacity over its entire surface. Such wrapping papers also lead to reliable self-extinguishing. The diffusion capacity can also be selected to be high enough for no or no frequent self-extinguishing to occur. Such smoking articles then have a low smoldering speed, which can be of interest for some applications. It is also common to perforate such wrapping papers over the entire surface or a part of the surface so that during smoking of the smoking article, air flows through the perforation into the smoking article and dilutes the aerosol that is generated. It has been shown that even intense perforation does not noticeably reduce the probability for self-extinguishing.

In the prior art, however, wrapping papers have become established for the purposes of self-extinguishing of smoking articles that are equipped with band-shaped regions in the circumferential direction in which the diffusion capacity is locally reduced. In practice, attempts to produce wrapping papers with a uniform sufficiently low diffusion capacity for the purposes of self-extinguishing have not yet yielded satisfactory results. On the one hand, it has been proved difficult for wrapping papers that contain filler materials to achieve a sufficiently low diffusion capacity for the purposes of self-extinguishing at all. Furthermore, in practice, such wrapping papers can not be produced in a manner that can reliably comply with legal requirements with respect to self-extinguishing.

It could be possible to attempt to circumvent this problem by selecting a particularly low diffusion capacity in order to be on the safe side. However, this is not desirable because then, the smoking article would self-extinguish frequently during smoking, which would reduce the consumer's acceptance of such smoking articles. In addition, for smoking articles containing such wrapping papers, the content of harmful gases like carbon monoxide also increases in the aerosol. This even holds for smoking articles in which the wrapping paper is additionally perforated to increase the air permeability.

Thus, there is an interest in having a wrapping paper for smoking articles available that, despite a considerable filler content, enables the probability of self-extinguishing or a low smoldering speed of a smoking article manufactured therefrom to be adjusted in a reliable and stable manner.

SUMMARY OF THE INVENTION

It is an objective of the invention to provide a wrapping paper for a smoking article that, despite a considerable filler content, enables the probability of self-extinguishing or a low smoldering speed of a smoking article manufactured therefrom to be adjusted in a reliable and stable manner. In the context of this invention, a "wrapping paper" should be understood to mean only that paper that wraps the aerosol-generating material, because only this paper has an influence on the self-extinguishing or the smoldering speed of the smoking article. Filter wrapping papers and tipping papers are not wrapping papers in the context of this invention.

This objective is achieved by a wrapping paper for a smoking article and a smoking article according to the claimed invention. Furthermore, it is achieved by a process for manufacturing a wrapping paper according to the claimed invention. Advantageous embodiments are provided in the dependent claims.

The inventors have found that this objective can be achieved by a wrapping paper that is suitable for the application to smoking articles and which comprises long-fiber pulp, short-fiber pulp and inorganic filler material, wherein at least a part of the long-fiber pulp is refined and the refined long-fiber pulp makes up at least 15% and at most 70% of the mass of the wrapping paper and wherein at least a part of the short-fiber pulp is refined and the refined short-fiber pulp makes up at least 5% and at most 80% of the mass of the wrapping paper, and the refined short-fiber pulp has a degree of refining of at least 20° SR and at most 60° SR, and wherein the short-fiber pulp in total makes up at least 10% and at most 80% of the mass of the wrapping paper, and wherein at least 5% and at most 45% of the mass of the wrapping paper is formed by one or more inorganic filler materials, and the basis weight of the wrapping paper is at least 15 $g/m^2$ and at most 45 $g/m^2$, and the diffusion capacity of the wrapping paper is at least 0.05 cm/s and at most 0.5 cm/s, and the standard deviation of the diffusion capacity of the wrapping paper is at most 0.05 cm/s.

A wrapping paper for smoking articles with low diffusion capacity is, for example, described in WO 2011/120687 A1. In that wrapping paper, however, the diffusion capacity had to be selected to be very low in order to safely comply with the legal requirements with respect to self-extinguishing. A further wrapping paper that has the same problems is also described in WO 2020/201716.

In extensive experiments, the inventors have determined the presumable cause of this problem. Self-extinguishing of a smoking article is substantially determined by the diffusion capacity of the wrapping paper, but the transition from 100% self-extinguishing to 0% self-extinguishing takes place in a very narrow interval of the diffusion capacity with a width of about 0.3 cm/s, wherein the position of the interval substantially depends on the construction of the smoking article, in particular the aerosol-generating material. As an example, if the probability of self-extinguishing is to be adjusted to ±10%, then the diffusion capacity needs to be adjusted to at least ±0.03 cm/s. The inventors have found that for such a narrow range of the required diffusion capacity, it is not sufficient to adjust the mean diffusion capacity in the production process, which is not even possible for wrapping papers of the prior art if the wrapping papers contain filler material. Additionally, it is important that the diffusion capacity of the wrapping paper also has a sufficiently low standard deviation, specifically a standard deviation that is less than 0.05 cm/s. For the aforementioned known wrapping papers with a low diffusion capacity, the standard deviations were significantly above this limit.

While the diffusion capacity, measured in accordance with CORESTA Recommended Method (CRM) 77, describes the permeability of the wrapping paper for $CO_2$ due to a concentration difference, the air permeability, measured in accordance with ISO 2965:2019 in $cm^3/(cm^2 \cdot min)$, indicates the permeability of the wrapping paper for air due to a pressure difference of 1 kPa. Wrapping papers for smoking articles usually contain long-fiber pulp, i.e., pulp from coniferous wood or certain annual plants, and the skilled person can, inter alia, adjust the air permeability by refining the long-fiber pulp, with the expectation that the diffusion capacity will also be adjusted. This is an obvious process, because the air permeability can be approximately measured on-line during paper production. Two problems arise from this.

On the one hand, while the diffusion capacity and the air permeability are both determined by the pore structure of the wrapping paper, they are not directly related. In particular, the type of long-fiber pulp, for example, a change from wood pulp to pulp from annual plants, or the inorganic filler material content can change the diffusion capacity independently of the air permeability. Thus, it is not possible, at least not for low diffusion capacities, to accurately adjust the diffusion capacity by way of the air permeability.

On the other hand, if the air permeability for a given composition of the wrapping paper is essentially adjusted by refining the long-fiber pulp, the diffusion capacity D and the air permeability Z are approximately related to each other by $D \approx k \cdot Z^{0.5}$, wherein k is a constant of proportionality. For low air permeabilities Z, the rate of change dD/dZ becomes very high, which means that even very small changes in the air permeability cause substantial changes in the diffusion capacity. As in this low range the air permeability cannot be determined to less than ±2 $cm^3/(cm^2 \cdot min)$ even on separate instruments due to the inevitable leakage flow in the region of the measuring head, it cannot be adjusted more accurately. The resulting diffusion capacity deviates correspondingly strongly from the target value.

The inventors have found that substantial progress can be made if the diffusion capacity itself becomes the actual target parameter of a feedback control in the manufacturing process. Furthermore, they have found that additional actuating variables are needed in order to adjust the diffusion capacity and keep its standard deviation low. According to the invention, these additional actuating variables are the degree of refining of the short-fiber pulp and the mixing ratios of refined and unrefined pulp fibers or of long-fiber pulp and short-fiber pulp. Wrapping papers for smoking articles can contain short-fiber pulp to provide more volume to the wrapping paper. The proportion of short-fiber pulp should not be too high, because then the strength of the wrapping paper is reduced too much. Generally, short-fiber pulp is also not refined, because the skilled person would only expect higher energy consumption, but no advantages. In WO 2011/166012, however, a wrapping paper for smoking articles is described, wherein the short-fiber pulp is refined, but there, the objective is to provide a cheap wrapping paper that has sufficient strength despite an extremely high proportion of short-fiber pulp of at least 90% of the mass. The examples provided therein show an air permeability of above 75 $cm^3/(cm^2 \cdot min)$ and a diffusion capacity of more than 0.4 cm/s, both of which are too high to reliably achieve self-extinguishing of a smoking article. The fact that a smaller proportion of short-fiber pulp could provide the refining of short-fiber pulp with advantages with respect to setting low diffusion capacities was not recognized in WO 2011/166012.

In addition to the considerations above, the inventors have also found that a plurality of additional parameters in combination have to be appropriately selected in order to be at all able to adjust the diffusion capacity with the required accuracy and to achieve a low standard deviation of the diffusion capacity. This includes, inter alia, the degree of refining of the long-fiber pulp, the degree of refining of the short-fiber pulp, the proportions of refined and unrefined long-fiber pulp, the proportions of refined and unrefined short-fiber pulp, the inorganic filler material content and the basis weight.

The wrapping paper according to the invention contains long-fiber pulp, wherein at least a part of the long-fiber pulp is refined, and the refined long-fiber pulp makes up at least 15% and at most 70% of the mass of the wrapping paper; preferably, it makes up at least 20% and at most 65% of the mass of the wrapping paper.

The degree of refining of the refined long-fiber pulp, measured in accordance with ISO 5267-1:1993, is preferably at least 85° SR and at most 95° SR and particularly preferably at least 88° SR and at most 94° SR. These intervals are particularly advantageous for the typical composition according to the invention of the wrapping paper. For a particularly high or low filler material content and a particularly high or low content of refined short-fiber pulp, it can be advantageous to select a degree of refining outside of these intervals. The degree of refining of the long-fiber pulp is the essential parameter for adjusting the diffusion capacity on a large scale, wherein a high degree of refining leads to a low diffusion capacity. Because of the presence of filler material, even very intensely refined long-fiber pulp is not sufficient to reduce the diffusion capacity to particularly low values.

The long-fiber pulp in the context of this invention is pulp that is sourced from coniferous trees, preferably from spruce, pine or fir, or from flax, hemp, jute, ramie, bamboo, *abaci*, sisal, kenaf or cotton. Mixtures of pulps from these sources can also be used.

The wrapping paper according to the invention contains short-fiber pulp, wherein at least a part of the short-fiber pulp is refined and the refined short-fiber pulp makes up at least r % and at most 80% of the mass of the wrapping paper; preferably, it makes up at least 10% and at most 70% of the mass of the wrapping paper.

In the wrapping paper according to the invention, the degree of refining of the refined short-fiber pulp, measured in accordance with ISO 5267-1:1993, is at least 20° SR and at most 60° SR, preferably at least 25° SR and at most 50° SR.

Short-fiber pulp in the context of this invention is pulp that is sourced from deciduous trees, preferably beech, birch or *eucalyptus*, or from esparto grass. Mixtures of pulp from these sources can also be used.

In the wrapping paper according to the invention, the proportion of short-fiber pulp in total should not be too high and is at least 10% and at most 80%, preferably at least 30% and at most 75% of the mass of the wrapping paper.

The mixing ratio of refined long-fiber pulp, refined short-fiber pulp and, if present, unrefined long-fiber pulp and unrefined short-fiber pulp is primarily employed for the accurate adjustment of the diffusion capacity because it can be changed comparatively easily during the manufacture of the wrapping paper. It is, however, also within the scope of the invention to influence the diffusion capacity by changing the degree of refining of the long-fiber pulp or short-fiber pulp.

The inventors assume that the fine particles of the refined short-fiber pulp are distributed homogeneously over the volume of the wrapping paper and thus aid in positively influencing the pore structure. The homogenization of the fiber geometry due to the refining of the short-fiber pulp also contributes to that. Despite the filler material, the refined short-fiber pulp can achieve a particularly low diffusion capacity and additionally, the standard deviation of the diffusion capacity is decreased. Refining the short-fiber pulp thus provides an important contribution to achieving the objective of the invention, but it is not sufficient alone.

The wrapping paper according to the invention contains inorganic filler material, wherein the inorganic filler material makes up at least 5% and at most 45% of the mass of the wrapping paper, preferably at least 10% and at most 35% of the mass of the wrapping paper.

The inorganic filler material is preferably selected from the group consisting of calcium carbonate, magnesium carbonate, magnesium hydroxide, aluminum oxide, aluminum hydroxide, titanium dioxide, kaolin, talcum and mixtures thereof. Particularly preferably, the inorganic filler material is precipitated calcium carbonate.

Inorganic filler material is used in wrapping papers in the prior art, inter alia, because it provides the wrapping paper with a high brightness and opacity and is usually cheaper than pulp. Thus, the filler material content ought to be maximized. The inventors have found that a high filler material content has a negative influence on the pore structure of the wrapping paper and leads to an increase in the diffusion capacity and its standard deviation. This effect can be compensated for by the refined short-fiber pulp. It is known to produce wrapping papers without filler material, but these papers, particularly at a low diffusion capacity, have a low opacity, so that this option is not considered for the wrapping papers according to the invention.

The wrapping paper according to the invention has a basis weight of at least 15 g/m$^2$ and at most 45 g/m$^2$, preferably at least 20 g/m$^2$ and at most 35 g/m$^2$. The basis weight can be measured in accordance with ISO 536:2019. The inventors have found that too low a basis weight, particularly when filler material is simultaneously present, leads to a greater variation of the diffusion capacity over the surface of the wrapping paper than is beneficial for achieving a stable rate of self-extinguishing. At low basis weights, the wrapping paper is also thinner and is formed by only a few fiber layers. Thus, the pore structure and the diffusion capacity vary substantially over the surface. A higher basis weight in general also means a lower variability of various parameters, but it also means a higher material and energy consumption, so that the inventive and preferred interval is a good compromise between the material and energy consumption and the targeted properties.

The diffusion capacity of the wrapping paper according to the invention, measured in accordance with CRM 77, is at least 0.05 cm/s and at most 0.5 cm/s, preferably at least 0.1 cm/s and at most 0.45 cm/s and particularly preferably at least 0.1 cm/s and at most 0.39 cm/s.

The standard deviation of the diffusion capacity of the wrapping paper according to the invention is at least 0 cm/s and at most 0.05 cm/s, preferably at least 0.005 cm/s and at most 0.03 cm/s. The standard deviation is determined here by the measurement of the diffusion capacity in accordance with CRM 77 on at least 10 randomly selected positions on the wrapping paper.

According to the findings of the inventors, the inventive and preferred interval for the diffusion capacity is beneficial to achieving self-extinguishing of a smoking article or to reduce its smoldering speed. The specific value for the diffusion capacity for achieving a particular rate of self-extinguishing or a particular smoldering speed substantially depends on the construction of the smoking article and in particular on the aerosol-generating material. Although it would be desirable, it was found that at higher diffusion capacities, refining of the short-fiber pulp no longer has a noticeable effect. Apparently, the proportion of larger pores in the wrapping paper is then too high to be influenced by the particles of the refined short-fiber pulp.

Although it is possible in the context of the invention, it is not preferred for the wrapping paper to be additionally equipped with discrete regions to which a film-forming composition is applied in order to achieve self-extinguishing of a smoking article. In this case, there is no need for the wrapping paper to have a low diffusion capacity. The discrete regions typically have a low diffusion capacity, while the wrapping paper between the regions has a high diffusion capacity, so that the requirements of the invention regarding the diffusion capacity and its standard deviation are usually not fulfilled anyway. Preferably, the wrapping paper therefore has no discrete regions to which a film-forming composition has been applied or that serve the self-extinguishing of a smoking article manufactured therefrom.

However, according to the invention, a film-forming composition can be applied to the entire surface of the wrapping paper. In particular, such a film-forming composition can contain starch, starch derivatives, cellulose derivatives, alginates or other film-forming polymers. Such coatings can, for example, serve to reduce stains on the wrapping paper or to influence the components in the aerosol formed during use of the smoking article. It can also serve to further reduce the diffusion capacity of the wrapping paper.

In contrast to wrapping papers in the prior art, the air permeability is not explicitly set as a target parameter, but results primarily from the diffusion capacity and the composition of the wrapping paper. Preferably, the air permeability of the wrapping paper according to the invention, measured in accordance with ISO 2965:2019 at a pressure difference of 1 kPa, is at least 1 cm$^3$/(cm$^2$·min) and at most 25 cm$^3$/(cm$^2$·min) and particularly preferably at least 2 cm$^3$/(cm$^2$·min) and at most 20 cm$^3$/(cm$^2$·min).

The wrapping paper according to the invention can be perforated, so that during use of the smoking article manufactured therefrom, air flows into the smoking article and dilutes the aerosol. In a preferred embodiment, the wrapping paper is perforated and has a mean air permeability, measured in accordance with ISO 2965:2019 at a pressure difference of 1 kPa, of at least 50 $cm^3/(cm^2 \cdot min)$ and at most 200 $cm^3/(cm^2 \cdot min)$, particularly preferably at least 50 $cm^3/(cm^2 \cdot min)$ and at most 150 $cm^3/(cm^2 \cdot min)$.

The wrapping paper according to the invention can contain burn additives, wherein the burn additives make up at least 0.5% and at most 2% of the mass of the wrapping paper. Particularly preferably the amount of burn additives is at least 0.7% and at most 1.5% of the mass of the wrapping paper.

The burn additives can preferably be selected from the group consisting of citrates, malates, tartrates, acetates, nitrates, succinates, fumarates, gluconates, glycolates, lactates, oxalates, salicylates, α-hydroxy caprylates, phosphates, polyphosphates, chlorides and hydrogen carbonates or mixtures thereof and particularly preferably from the group consisting of trisodium citrate, tripotassium citrate and mixtures thereof.

The burn additives can influence the smoldering speed, but are also used to improve the ash appearance of the burned wrapping paper. In the prior art, burn additives are often used at between 2.0% and 5.0% of the mass of the wrapping paper. This amount, however, is too high to achieve a low smoldering speed for the smoking article and it also reduces the self-extinguishing rate. The indicated and preferred interval provides a good compromise between a low smoldering speed and a good ash appearance of the wrapping paper.

The thickness of the wrapping paper according to the invention is preferably at least 20 μm and at most 70 μm, preferably at least 22 μm and at most 60 μm. The thickness can be determined in accordance with ISO 534:2011 on a single layer of the wrapping paper.

The mechanical properties of the wrapping paper according to the invention can be important for the manufacture of a smoking article from this wrapping paper. The essential mechanical properties include the tensile strength and the elongation at break, primarily in the machine direction of the wrapping paper, which can both be determined in accordance with ISO 1924-2:2008.

The tensile strength of the wrapping paper according to the invention in the machine direction is preferably at least 8 N/15 mm and at most 30 N/15 mm, particularly preferably at least 10 N/15 mm and at most 25 N/15 mm. Intense refining of the long-fiber pulp is required because of the low diffusion capacity of the wrapping paper. This also increases the strength, so that the wrapping paper according to the invention generally has good strength without taking further measures.

In order to compensate for speed differences within a machine during the manufacture of the smoking article from the wrapping paper, it is beneficial if the wrapping paper has a certain extensibility. Preferably, the elongation at break of the wrapping paper according to the invention in the machine direction is at least 0.9% and at most 3%, particularly preferably at least 1% and at most 2%.

The wrapping paper is intended for use on smoking articles, and therefore smoking articles comprising the wrapping paper according to the invention are also an object of the invention.

The smoking article according to the invention comprises an aerosol-generating material and the wrapping paper according to the invention, wherein the wrapping paper wraps at least a part of the aerosol-generating material and forms a cylindrical rod.

Preferably, the smoking article according to the invention is a cigarette and particularly preferably a filter cigarette.

In a further embodiment, the smoking article according to the invention is a smoking article in which during the intended use, the aerosol-generating material is only heated but not burned; particularly preferably, the smoking article is intended to be electrically heated.

For smoking articles for which the aerosol-generating material is only heated but not burned, the demand for the wrapping paper according to the invention does not result from the need to achieve a low smoldering speed. It can be of advantage, however, to accurately adjust the diffusion capacity of the wrapping paper in order to control the diffusion of gases in the aerosol, for example, oxygen, carbon dioxide or carbon monoxide, more precisely. Furthermore, with the wrapping paper according to the invention, such a smoking article cannot be smoked like a cigarette and no stable smoldering process can be established after lighting.

The wrapping paper according to the invention can be manufactured according to the following process according to the invention that comprises the steps A to E, I and J:

A—providing an aqueous suspension of unrefined long-fiber pulp,

B—providing an aqueous suspension of unrefined short-fiber pulp,

C—refining at least a part of the long-fiber pulp in the suspension from step A to a first target value for the degree of refining, D—refining at least a part of the short-fiber pulp in the suspension from step B to a second target value for the degree of refining, E—forming a fiber web from at least the refined long-fiber pulp from step C, the refined short-fiber pulp from step D and inorganic filler material, and optionally unrefined long-fiber pulp and/or unrefined short-fiber pulp, I—drying the fiber web to obtain a wrapping paper, J—removing the wrapping paper, wherein in step E, the amount of refined long-fiber pulp from step C is selected such that at least 15% and at most 70% of the mass of the wrapping paper in step J is formed by refined long-fiber pulp, wherein in step E, the amount of refined short-fiber pulp from step D is selected such that at least 5% and at most 80% of the mass of the wrapping paper in step J is formed by refined short-fiber pulp, wherein the short-fiber pulp in step D is refined to a degree of refining of at least 20° SR and at most 60° SR, wherein in step E, the total amount of short-fiber pulp is selected such that at least 10% and at most 80% of the mass of the wrapping paper in step J is formed by short-fiber pulp, wherein in step E, the amount of inorganic filler material is selected such that at least 5% and at most 45% of the mass of the wrapping paper in step J is formed by inorganic filler material, and wherein during forming of the fiber web in step E, the amounts and proportions of refined long-fiber pulp, refined short-fiber pulp, inorganic filler material, and optional unrefined long-fiber pulp and/or unrefined short-fiber pulp are selected such that the wrapping paper in step J has the following properties:

a basis weight of at least 15 $g/m^2$ and at most 45 $g/m^2$, a diffusion capacity of at least 0.05 cm/s and at most 0.5 cm/s, and a standard deviation of the diffusion capacity of at most 0.05 cm/s.

It should be noted that in step E in any case, refined long-fiber pulp and refined short-fiber pulp are used to form the fiber web. The additional use of unrefined long-fiber pulp or unrefined short-fiber pulp, however, is optional.

In an advantageous embodiment, the process is monitored and adapted in order to ensure that the finished wrapping paper in fact has the desired diffusion capacity, in the following called "target value" of the diffusion capacity. This can in particular be carried out in the context of a feedback or feedforward control process.

To this end, the process can contain the following steps between the steps E and I:

F—drying the fiber web to obtain a preliminary wrapping paper,

G—measuring the diffusion capacity of the preliminary wrapping paper from step F, H—checking whether the absolute difference between the diffusion capacity measured in step G and the target value exceeds a pre-determined threshold, and, if that is case, adapting the manufacturing process by at least one of the following adaptation steps H.1 to H.6:

H.1—changing the first target value for the degree of refining in step C,

H.2—changing the second target value for the degree of refining in step D,

H.3—changing the proportion of unrefined long-fiber pulp when forming the fiber web in step E, H.4—changing the proportion of unrefined short-fiber pulp when forming the fiber web in step E, H.5—changing the proportion of refined long-fiber pulp when forming the fiber web in step E, H.6—changing the proportion of refined short-fiber pulp when forming the fiber web in step E.

In advantageous embodiments, the threshold in step H is at least 0.01 cm/s and at most 0.07 cm/s.

The term "preliminary wrapping paper" indicates that, depending on the deviation of the diffusion capacity from the target value, this wrapping paper potentially does not fulfill the requirements and needs to be rejected. At sufficiently small deviations from the target value, the preliminary wrapping paper can, however, be used for the purposes of the invention and then forms the wrapping paper of step J, wherein then, the steps F and I coincide. It should be noted that the threshold for the deviation from the target value in step H, which leads to an adaptation of the manufacturing process, is in general lower than a deviation which makes rejection of the preliminary wrapping paper necessary. In preferred embodiments, the process is continuously adapted by the adaptation steps H.1 to H.6, so that deviations of the diffusion capacity from the target value are not so large that the "preliminary wrapping paper" has to be rejected.

For the adaptation steps H.3 and H.4, it should be noted that "changing the proportion of unrefined long-fiber pulp/short-fiber pulp" can, in particular, mean that unrefined long-fiber pulp/short-fiber pulp is added for the first time, i.e. it was not used at all before this adaptation step, or that this is omitted after it has been used before this adaptation step.

Preferably, the amount of the refined long-fiber pulp in step E is selected such that at least 20% and at most 65% of the mass of the wrapping paper is formed by refined long-fiber pulp.

The first target value for the degree of refining in step C, measured in accordance with ISO 5267-1:1993, is preferably at least 85° SR and at most 95° SR and particularly preferably at least 88° SR and at most 94° SR.

The long-fiber pulp in the context of this invention is pulp that is sourced from coniferous trees, preferably spruce, pine or fir, or from flax, hemp, jute, ramie, bamboo, abacá, sisal, kenaf or cotton. Mixtures of pulps from these origins can also be used.

Preferably, the amount of the refined short-fiber pulp in step E is selected such that at least 10% and at most 70% of the mass of the wrapping paper in step J is formed by refined short-fiber pulp.

The second target value for the degree of refining in step D, measured in accordance with ISO 5267-1:1993, is preferably at least 25° SR and at most 50° SR.

Short-fiber pulp in the context of this invention is pulp that is sourced from deciduous trees, preferably beech, birch, or *eucalyptus*, or from esparto grass. Mixtures of pulps from these sources can also be used.

Preferably, the total amount of short-fiber pulp in step E is selected such that at least 30% and at most 75% of the mass of the wrapping paper in step J is formed by short-fiber pulp.

Preferably, the amount of inorganic filler material in step E is selected such that at least 10% and at most 35% of the mass of the wrapping paper is formed by inorganic filler material.

The inorganic filler material is preferably selected from the group consisting of calcium carbonate, magnesium carbonate, magnesium hydroxide, aluminum oxide, aluminum hydroxide, titanium dioxide, kaolin, talcum, and mixtures thereof. Particularly preferably, the inorganic filler material is precipitated calcium carbonate.

The wrapping paper in step J preferably has a basis weight of at least 20 g/m$^2$ and at most 35 g/m$^2$.

The diffusion capacity of the wrapping paper in step J, measured in accordance with CRM 77, is preferably at least 0.1 cm/s and at most 0.45 cm/s and particularly preferably at least 0.1 cm/s and at most 0.39 cm/s.

The standard deviation for the diffusion capacity of the wrapping paper in step J is preferably at least 0.005 cm/s and at most 0.03 cm/s.

Preferably, the fiber web in step E is formed on a paper machine, particularly preferably on a Fourdrinier machine. The skilled person can select the details for manufacturing a fiber web on a paper machine according to their experience.

Preferably, the drying the fiber web in step F or I can be carried out by contact with heated cylinders, by contact with hot air, by infra-red radiation or by micro-wave radiation.

Preferably, the diffusion capacity in step G is determined by the mean value of at least 10 measurements in accordance with CRM 77 at randomly selected positions.

Preferably, the threshold in step H is at least 0.02 cm/s and at most 0.05 cm/s. The threshold in step H should not be selected so as to be too low, in particular not lower than the accuracy of the measurement of diffusion capacity. The extent to which, in at least one of steps H.1 to H.6, the first target value for step C, the second target value for step D or the proportions of pulp fibers in steps H.3 to H.6 are changed, can be determined by the skilled person according to their experience, by experiments or with the aid of control theory methods.

If the diffusion capacity measured in step G is substantially too high, it is beneficial to increase the first target value for the degree of refining in step C, step H.1, or to reduce the proportion of unrefined long-fiber pulp, step H.3, and at the same time to increase the proportion of refined long-fiber pulp, step H.5, because the degree of refining of the long-fiber pulp has the greatest influence on the diffusion capacity. In this regard, here and below, the "proportion" always refers to the proportion when forming the fiber web in step E. In this case it is also efficient to reduce the proportion of short-fiber pulp, step H.4 or step H.6, and to increase the proportion of long-fiber pulp, step H.5.

If the diffusion capacity measured in step G is only slightly too high, it is beneficial to increase the second target value for the degree of refining in step D, step H.2, or to reduce the proportion of the unrefined short-fiber pulp, step H.4, and at the same time to increase the proportion of the refined short-fiber pulp, step H.6. In this case, it is also efficient to reduce the proportion of unrefined long-fiber pulp, step H.3, and at the same time to increase the proportion of refined short-fiber pulp, step H.6. The degree of refining of the short-fiber pulp has a smaller effect on the diffusion capacity, but it enables the diffusion capacity to be reduced further than is possible with refined long-fiber pulp alone.

If the standard deviation for the diffusion capacity is to be reduced, then it is beneficial to increase the proportion of refined short-fiber pulp, step H.6, and at the same time to reduce the proportion of refined long-fiber pulp, step H.5. Possibly, it may also require an adaptation of the first or second target value for the degree of refining, step H.1 or step H.2. Preferably, step H is the implementation of a combination of two of the steps H.1 to H.6 if the absolute difference between the diffusion capacity measured in step G and the target value of the diffusion capacity exceeds the threshold.

Particularly preferably, step H is the implementation of at least one of the following combinations of two of steps H.3 to H.6: H.3 and H.5; H.4 and H.5; H.6 and H.5; H.4 and H.6; H.3 and H.6, if the absolute difference between the diffusion capacity measured in step G and the target value for the diffusion capacity exceeds the threshold.

More particularly preferably, step H is the implementation of a combination of three of steps H.1 to H.6 if the absolute difference between the diffusion capacity measured in step G and the target value for the diffusion capacity exceeds the threshold.

In particular, step H is the implementation of at least one of the following combinations of three of the steps H.1 to H.6: H.1, H.3 and H.5; H.2, H.3 and H.5; H.1, H.4 and H.5; H.2, H.4 and H.5; H.1, H.6 and H.5; H.2, H.6 and H.5; H.1, H.4 and H.6; H.2, H.4 and H.6; H.1, H.3 and H.6; H.2, H.3 and H.6, if the absolute difference between the diffusion capacity measured in step G and the target value for the diffusion capacity exceeds the threshold.

Preferably, the removal of the wrapping paper in step J comprises winding up on a reel or cutting the wrapping paper into bobbins of a defined width.

DESCRIPTION OF SOME PREFERRED EMBODIMENTS AND EXAMPLES FOR COMPARISON

Some preferred embodiments of wrapping papers according to the invention will be described below.

Exemplary Embodiments

Several wrapping papers according to the invention were manufactured using the process according to the invention. The composition of the wrapping papers is shown in Table 1, wherein "LF" is the content of refined long-fiber pulp with respect to the mass of the wrapping paper, "SF-α" is the content of unrefined short-fiber pulp with respect to the mass of the wrapping paper, "SF-R" is the content of refined short-fiber pulp with respect to the mass of the wrapping paper, "FI" is the content of inorganic filler material with respect to the mass of the wrapping paper, "DR-L" is the degree of refining of the refined long-fiber pulp, "DR-S" is the degree of refining of the refined short-fiber pulp, "BW" is the basis weight, "MW" is the mean diffusion capacity and "SD" is the standard deviation for the diffusion capacity. All wrapping papers according to the invention from Table 1 respectively contained 0.5% to 1.5% citrate as a burn additive, with respect to the mass of the wrapping paper. The entirety of the long-fiber pulp proportion was formed by refined long-fiber pulp.

TABLE 1

| | Composition | | | | DR-L | DR-S | BW | Diffusion Capacity | |
|---|---|---|---|---|---|---|---|---|---|
| | | | | | | | | MW | SD |
| Paper | LF % | SF-U % | SF-R % | FI % | ° SR ISO 5267-1 | ° SR ISO 5267-1 | g/m² ISO 536 | cm/s CRM 77 | cm/s CRM 77 |
| 1 | 45 | 18 | 16 | 20 | 92 | 40 | 29 | 0.12 | 0.013 |
| 2 | 39 | 24 | 16 | 20 | 94 | 40 | 28 | 0.18 | 0.017 |
| 3 | 30 | 33 | 16 | 20 | 93 | 40 | 27 | 0.24 | 0.016 |
| 4 | 19 | 44 | 16 | 20 | 92 | 40 | 26 | 0.32 | 0.017 |
| 5 | 42 | 20 | 16 | 21 | 92 | 40 | 30 | 0.16 | 0.020 |
| 6 | 30 | 29 | 25 | 15 | 93 | 40 | 25 | 0.32 | 0.019 |
| 7 | 28 | 31 | 25 | 15 | 94 | 40 | 25 | 0.39 | 0.024 |
| 8 | 26 | 32 | 26 | 15 | 94 | 40 | 25 | 0.44 | 0.049 |
| 9 | 20 | 55 | 9 | 15 | 93 | 40 | 30 | 0.40 | 0.043 |

Comparative Examples

Several wrapping papers not according to the invention were manufactured; the data are summarized in Table 2, wherein the abbreviations have the same meaning as in Table 1. Also, the wrapping papers not according to the invention A and B respectively contained 0.5% to 1.5% citrate as a burn additive. The wrapping paper C, not according to the invention, did not contain burn additives. The entirety of the long-fiber pulp proportion was formed by refined long-fiber pulp.

TABLE 2

| | Composition | | | | DR-L | DR-S | BW | Diffusion Capacity | |
|---|---|---|---|---|---|---|---|---|---|
| | | | | | | | | MW | SD |
| Paper | LF % | SF-U % | SF-R % | FI % | ° SR ISO 5267-1 | ° SR ISO 5267-1 | g/m² ISO 536 | cm/s CRM 77 | cm/s CRM 77 |
| A | 40 | 39 | 0 | 20 | 95 | — | 48 | 0.25 | 0.048 |
| B | 40 | 39 | 0 | 20 | 93 | — | 27 | 0.52 | 0.063 |
| C | 75 | 0 | 0 | 25 | 92 | — | 26 | 0.23 | 0.056 |

The wrapping papers 1 to 9 according to the invention show that over a specific range regarding basis weight, content of refined long-fiber pulp, refined and unrefined short-fiber pulp and the filler content, a very low standard deviation could be obtained for the diffusion capacity. By intense refining of the entirety of the long-fiber pulp, the diffusion capacity was shifted to a low range and the specific value for the diffusion capacity was primarily adjusted by the mixture of refined and unrefined short-fiber pulp. Due to the natural variability of the raw materials, this ratio had to be individually adjusted for each production batch.

Compared with the wrapping papers 1 to 7, the wrapping paper 9 according to the invention, with a content of unrefined short-fiber pulp of only 9% of the mass of the wrapping paper, has a significantly higher standard deviation for the diffusion capacity, so that this comes close to the limits of the invention.

The wrapping paper 8 according to the invention is also almost at the limits of the invention, in particular compared with wrapping paper 7. The essential difference is the diffusion capacity, which for wrapping paper 8 is 0.44 cm/s and is slightly higher than for wrapping paper 7, with 0.39 cm/s. Apparently, at this diffusion capacity, the effect of the refined short-fiber pulp decreases so that the standard deviation for the diffusion capacity can no longer be reduced so efficiently.

In the wrapping papers 1 to 9 according to the invention, the filler content is selected to be rather low. If the filler content is to be increased, for example to 40% or 45% of the mass of the wrapping paper, then it is beneficial to further increase the degree of refining of the short-fiber pulp and also to increase the proportion of refined short-fiber pulp and to reduce the proportion of unrefined short-fiber pulp.

The wrapping paper A not according to the invention is very similar to the wrapping paper 5 according to the invention, but has a higher basis weight of 48 g/m$^2$ and does not contain refined short-fiber pulp. It can be seen that the standard deviation for the diffusion capacity for comparative example A is significantly higher than for the wrapping paper 5, but is in an acceptable range, so that at this high basis weight, refined short-fiber pulp is no longer required.

For the wrapping paper B not according to the invention, no refined short-fiber pulp was used and despite the otherwise almost identical properties as for wrapping paper 2 according to the invention, it was not possible to reduce the diffusion capacity sufficiently and, furthermore, the standard deviation for the diffusion capacity was more than twice as high.

Finally, the wrapping paper C not according to the invention shows that a wrapping paper that consists exclusively of refined long-fiber pulp and filler material can indeed achieve a low diffusion capacity, but the standard deviation for the diffusion capacity is too high. This is caused by the proportion of filler material and, as shown by the approximately similar exemplary embodiment 4, can be compensated for by using refined short-fiber pulp.

It can be seen from the wrapping papers according to the invention and the comparative examples not according to the invention that in fact the combination of several features, in particular the basis weight, the degree of refining of the short-fiber pulp, the mixing ratio between refined and unrefined short-fiber pulp and the filler content in the wrapping paper, is relevant in order to obtain the advantages according to the invention.

The invention claimed is:

1. Wrapping paper for a smoking article, which comprises long-fiber pulp, short-fiber pulp, and inorganic filler material, wherein at least a part of the long-fiber pulp is refined and the refined long-fiber pulp makes up at least 15% and at most 70% of the mass of the wrapping paper, wherein at least a part of the short-fiber pulp is refined and the refined short-fiber pulp makes up at least 5% and at most 80% of the mass of the wrapping paper, and the refined short-fiber pulp has a degree of refining of at least 20° SR and at most 60° SR, wherein the short-fiber pulp in total makes up at least 10% and at most 80% of the mass of the wrapping paper, wherein at least 10% and at most 35% of the mass of the wrapping paper is formed by one or more inorganic filler materials, wherein said wrapping paper has an air permeability, measured in accordance with ISO 2965:2019 at a pressure difference of 1 kPa, of at least 1 cm$^3$/(cm$^2$·min) and at most 25 cm$^3$/(cm$^2$·min), wherein the wrapping paper comprises burn additives, wherein the burn additives make up at least 0.5% and at most 2% of the mass of the wrapping paper, wherein the basis weight of the wrapping paper is at least 15 g/m$^2$ and at most 45 g/m$^2$, and wherein the diffusion capacity of the wrapping paper is at least 0.05 cm/s and at most 0.5 cm/s, and wherein the standard deviation for the diffusion capacity of the wrapping paper is at most 0.05 cm/s.

2. Wrapping paper according to claim 1, in which the degree of refining of the refined long-fiber pulp, measured in accordance with ISO 5267-1:1993, is at least 88° SR and at most 94° SR.

3. Wrapping paper according to claim 1, in which the degree of refining of the refined short-fiber pulp, measured in accordance with ISO 5267-1:1993, is at least 25° SR and at most 50° SR.

4. Wrapping paper according to claim 1, in which the proportion of the short-fiber pulp makes up at least 30% and at most 75% of the mass of the wrapping paper.

5. Wrapping paper according to claim 1, in which the diffusion capacity, measured in accordance with CRM 77, is at least 0.1 cm/s and at most 0.39 cm/s.

6. Wrapping paper according to claim 1, in which the standard deviation for the diffusion capacity is at least 0.005 cm/s and at most 0.03 cm/s, wherein the standard deviation is determined by measurement of the diffusion capacity in accordance with CRM 77 on at least 10 randomly selected positions on the wrapping paper.

7. Wrapping paper according to one claim 1, onto which either no film-forming composition has been applied, or onto which a film-forming composition which contains starch, starch derivatives, cellulose derivatives, alginates or other film-forming polymers is applied to the entire surface.

8. Wrapping paper according to claim 1, the thickness of which, measured in accordance with ISO 534:2011, is at least 22 μm and at most 60 μm.

9. Smoking article comprising an aerosol-generating material and a wrapping paper according to claim 1, wherein the wrapping paper wraps at least a part of the aerosol-generating material and forms a cylindrical rod.

10. Smoking article according to claim 9, which is formed by a cigarette.

11. Smoking article according to claim 9, in which the aerosol-generating material is only heated but not burned during intended use, wherein the smoking articles is intended to be heated electrically.

* * * * *